US005941108A

United States Patent [19]

Shen

[11] Patent Number: 5,941,108

[45] Date of Patent: Aug. 24, 1999

[54] PUSH BUTTON FOR A TUBULAR LOCK UNLOCKABLE BY AN INSIDE HANDLE THEREOF

[76] Inventor: Mu-Lin Shen, No. 32, Lane 76, Sec. 5, Fu-An Road, Tainan, Taiwan

[21] Appl. No.: 09/148,113

[22] Filed: Sep. 4, 1998

[51] Int. Cl.[6] ..... E05B 55/04

[52] U.S. Cl. ..... 70/467; 70/224; 292/336.3; 292/347

[58] Field of Search ..... 292/336.3, 347; 70/224, 215–217, 467

[56] References Cited

U.S. PATENT DOCUMENTS

| | | | |
|---|---|---|---|
| 5,157,953 | 10/1992 | Hung | 70/224 |
| 5,177,987 | 1/1993 | Shen | 70/224 |
| 5,284,372 | 2/1994 | Lin | 292/336.3 |
| 5,301,526 | 4/1994 | Fann et al. | 70/224 |
| 5,598,726 | 2/1997 | Cordle | 292/336.3 |
| 5,761,936 | 6/1998 | Katayama | 70/224 |
| 5,768,926 | 6/1998 | Shen | 70/224 |
| 5,816,086 | 10/1998 | Russell, IV | 292/336.3 |

*Primary Examiner*—Suzanne Dino Barrett
*Assistant Examiner*—Teri Pham
*Attorney, Agent, or Firm*—Rosenberg, Klein & Bilker

[57] ABSTRACT

A tubular lock includes an outside handle assembly and an inside handle assembly. A push button has an end that is normally extended beyond an inside handle when the tubular lock is in an unlocked status. When the push button is pushed, the tubular lock can be unlocked by rotating the inside handle to prevent the user from being inadvertently locked out.

5 Claims, 8 Drawing Sheets

PUSH BUTTON FOR A TUBULAR LOCK UNLOCKABLE BY AN INSIDE HANDLE THEREOF

BACKGROUND OF THE INVENTION

1. Field of the Invention

The present invention relates to a tubular lock having a push button to allow unlocking from inside to thereby prevent from the user being inadvertently locked outside.

2. Description of the Related Art

The inside handle of a tubular lock generally includes a turn button that can be rotated through an angle to a locking position such that the door can only be opened from inside by manually rotation of the handle or from outside by a key. Yet, if the turn button is in such a locking status, if one opens the door and walks outside, he may be inadvertently locked out if not aware of the status of the turn button. The present invention is intended to provide an improved tubular lock with a push button to solve this problem.

SUMMARY OF THE INVENTION

It is a primary object of the present invention to provide a tubular lock that uses a push button to replace the conventional turn button, in which the push button mounted in the inside handle that is in a pushed, locked position can be unlocked by either simple rotation of the inside handle or an unlocking device (e.g., a key). Thus, one can be prevented from being locked out even if he is not aware of the status of the push button.

A tubular lock in accordance with the present invention comprises:

an outside handle assembly including an outside handle, an outside spindle having a first end securely attached to the outside handle to rotate therewith and a second end, a cam mounted in the second end of the outside spindle and secured to the outside handle to rotate therewith, an outside rose liner adapted to be mounted to a door panel, an outside rose securely mounted around the outside rose liner, and an outside retractor mounted to the second end of the outside spindle, an inside handle assembly including an inside handle, an inside spindle having a first end securely attached to the inside handle to rotate therewith, a second end, and a retaining slot defined in an outer periphery thereof, an inside rose liner adapted to be mounted to the door panel and including two locking grooves defined therein, an inside rose securely mounted around the inside rose liner, an inside retractor mounted to the second end of the inside spindle, a locking piece mounted around the spindle to rotate therewith and having two diametrically disposed lugs releasably engaged with the locking groove of the inside rose liner, and a first spring mounted between the locking piece and the inside retractor, the second end of the inside spindle further including a cutout defined in a periphery thereof, a push button assembly including:

an inner sleeve slidably and irrotatably mounted in the inside handle and including a first end, a wedge formed on an outer periphery thereof and retained in the cutout of the inside spindle, and a second end having a relatively shorter slot and a relatively longer slot defined therein, the relatively shorter slot being aligned with a portion of the relatively longer slot, a push button having a first end that is normally extended beyond the inside handle when the tubular lock is in an unlocked status and a second end securely engaged with the first end of the inner sleeve, and a catch having a first end with a second spring mounted therearound, a second end, and a rectangular hole, the first end being slidably received in the relatively shorter slot, and the second end of the catch being slidably received in the relatively longer slot, a square spindle extended between the outside handle assembly and the inside handle assembly and having a first end attached to the cam to rotate therewith and a second end, a first torsion spring being mounted around the first end of the spindle and having two ends attached to the outside retractor for returning the outside spindle and the outside handle, and a second torsion spring being mounted around the second end of the spindle and having two ends attached to the inside retractor for returning the inside spindle and the inside handle, a locking bar rotatably mounted in the spindle and having a first end adapted to be actuated by a key and a second end extended beyond the spindle in the inside spindle and engaged with the rectangular hole of the catch to move therewith, and a latch bolt driving member having a rectangular hole through which the spindle is extended to move therewith, the latch bolt driving member having an end adapted to be connected to a latch bolt to move therewith, whereby when the first end of the push button means is pressed into the inside handle, the locking piece is moved to engaged with and thus retained in the locking grooves of the inside rose liner while the catch is moved to a position in which the second end of the catch is moved into and thus retained in the retaining slot of the inside spindle under the action of the second spring, such that the tubular lock cannot be unlocked by rotation of the outside handle, yet rotation of the inside handle causes the second end of the catch to be disengaged from the retaining slot to unlock the tubular lock.

The inside spindle further includes an inner keeper mounted therein. A connecting sleeve is mounted to the second end of the spindle and a reduced section which extends through a hole of the inner keeper and through which the locking bar is extended.

The cutout in the second end of the inside spindle may include a first section, a second section, and a neck section between the first section and the second section. The second end of the inside spindle further includes a slit aligned with the cutout of the inside spindle to allow insertion of the catch into the inner sleeve via the slit and the relatively longer slot.

The first end of the inner sleeve includes a plurality of slots defined in an outer periphery thereof, and the second end of the push button includes a corresponding number of protrusions formed on an inner periphery thereof so as to be securely received in the slots.

By such arrangement, the risk of being locked out is prevented even if the user is not aware of the status of the push button, as the push button is not rotatable and can be unlocked by simple rotation of the inside handle.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
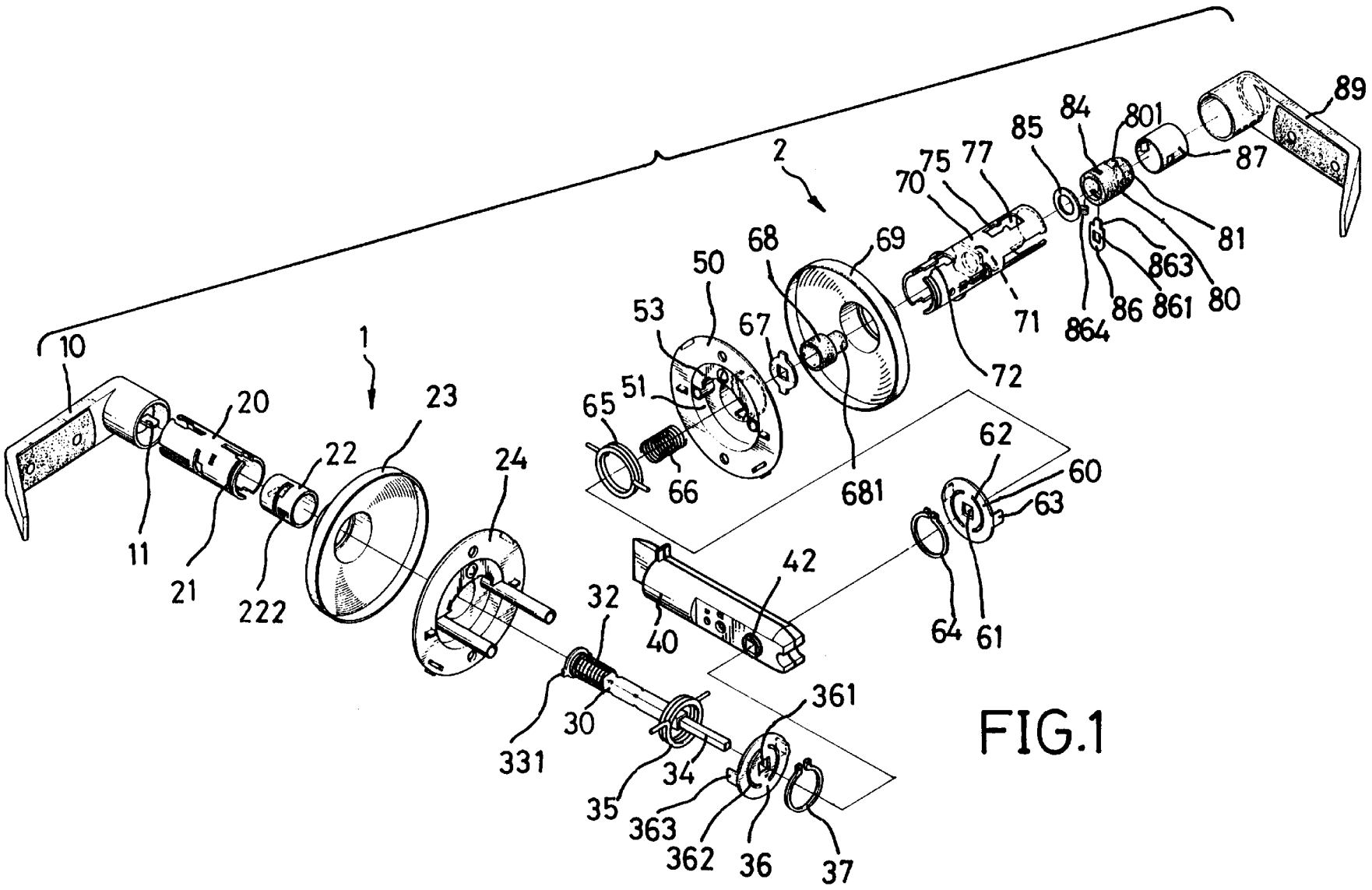
FIG. 1 is an exploded perspective view of a tubular lock in accordance with the present invention.
Figure 2:
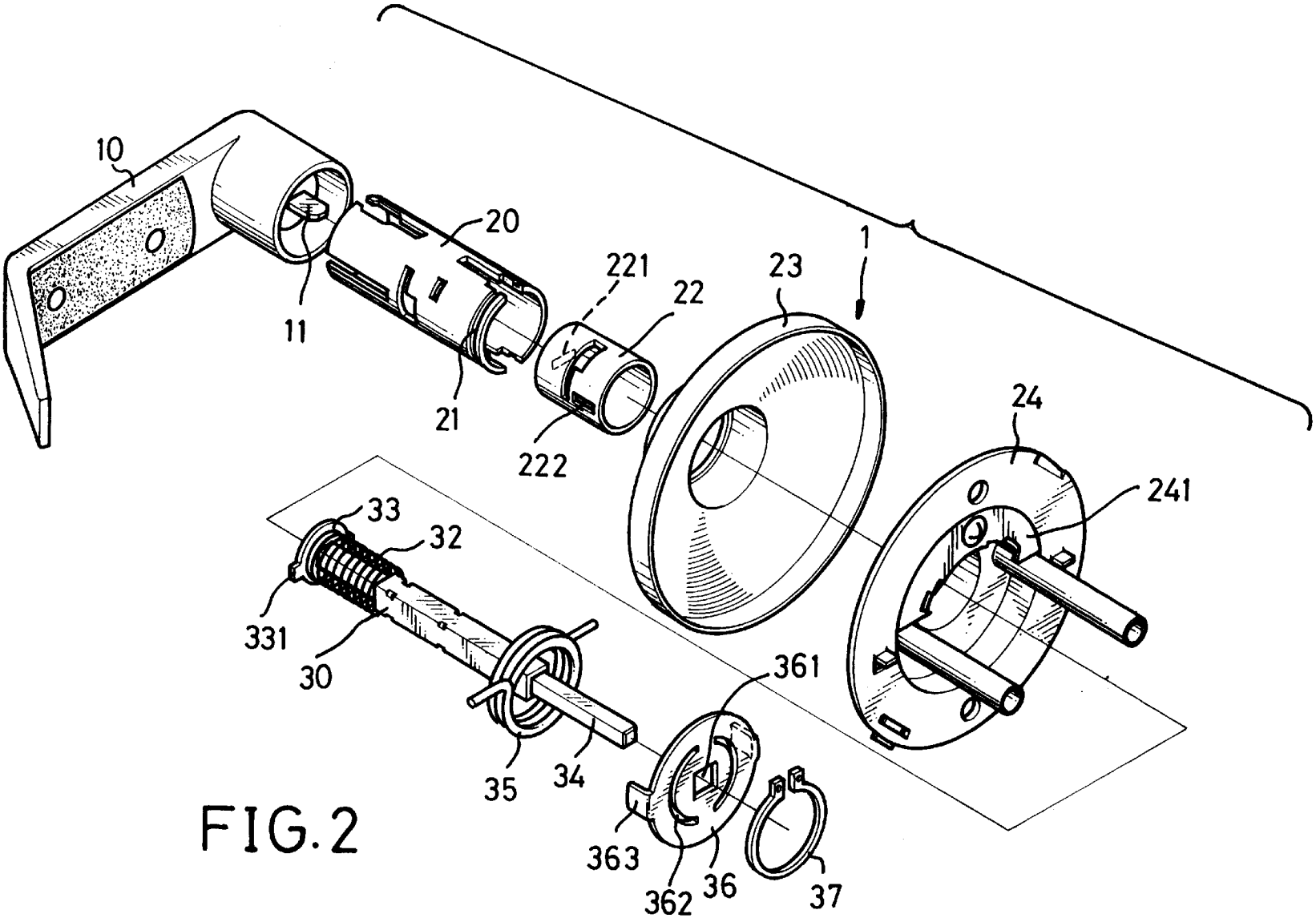
FIG. 2 is an exploded perspective view of an outside handle assembly of the tubular lock in accordance with the present invention.

Referring to the drawings and initially to FIG. 1, a tubular lock in accordance with the present invention generally includes an outside handle assembly 1, an inside handle assembly 2, and a latch bolt driving member 40. Referring to FIG. 2, the outside handle assembly 1 includes an outside handle 10 (e.g., a lever handle) with a tailpiece 11 provided at one end thereof, an outside spindle 20 having a first end securely engaged with the tailpiece 11 of the outside handle 10 to rotate therewith, a cam 22 mounted in a second end of the outside handle 10, an outside rose liner 24 mounted to a door panel 3 (FIG. 9), and an outside rose 23. The outside spindle 20 includes an groove 21 defined in an outer periphery of the second end thereof, while the cam 22 has a slot 221 defined in an end thereof for engaging with the tailpiece 11 of the outside handle 10 and a slot 222 defined in a periphery of the other end thereof, which will be described later.

Figure 9:
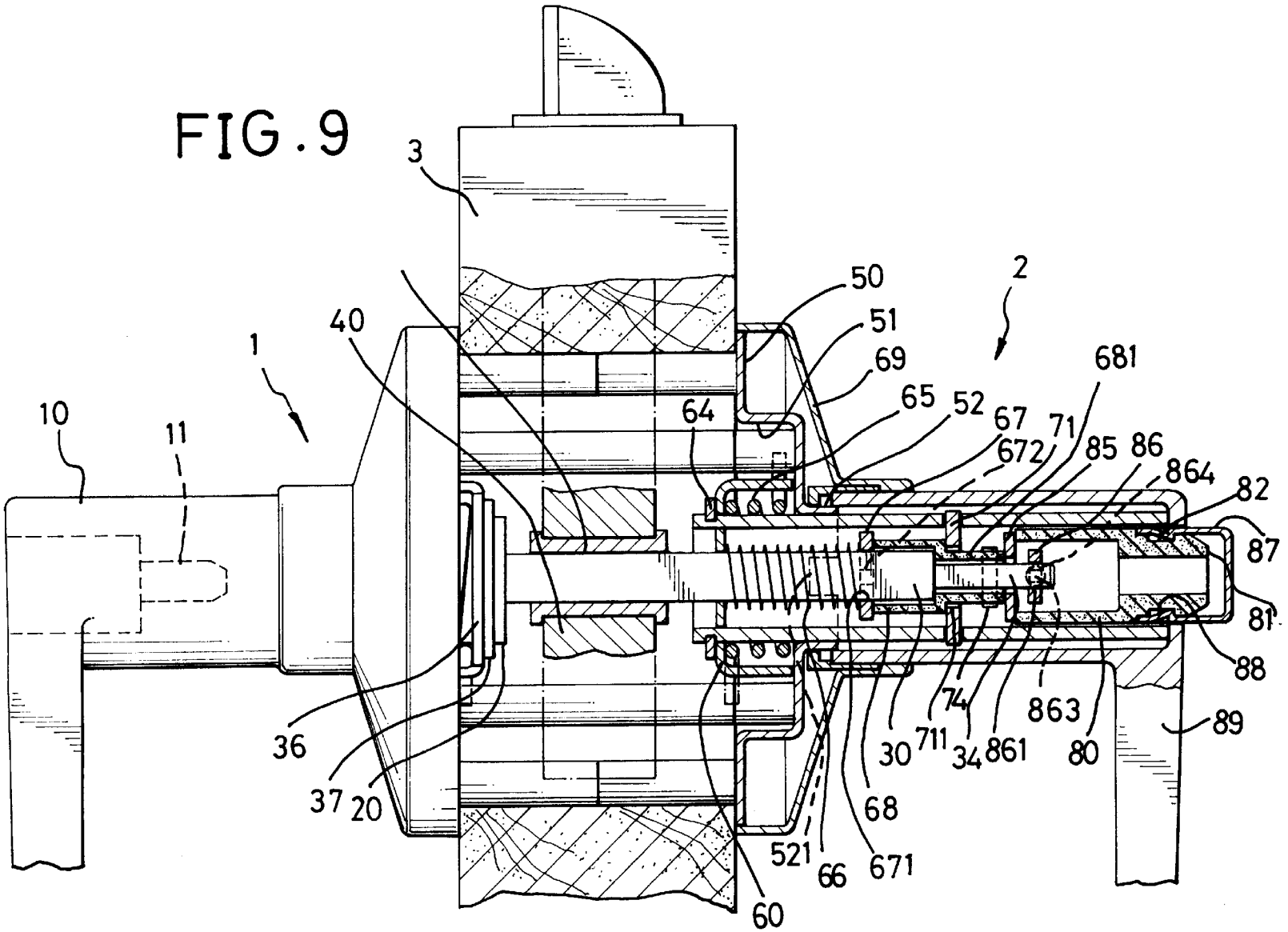
FIG. 9 is a partial longitudinal, horizontal sectional view of the tubular lock assembly in accordance with the present invention.

The outside rose 23 is mounted onto the outside rose liner 24 for housing the latter. A locking bar 34 is mounted in the door panel 3 (FIG. 9) and includes a first end with a retainer 33 formed thereon for engagement with the slot 222 of the cam 22 (see lugs 331 on the retainer 33) such that the locking bar 34 can be rotated upon insertion of a key into the outside handle 10. A lock spindle 30 is mounted around the locking bar 34 and allows free rotation of the locking bar 34 therein. As shown in FIG. 9, the spindle 30 is extended through a transverse hole 42 (FIG. 1) of the latch bolt driving member 40 that has an end connected to a latch bolt (not shown) to move therewith, which is conventional and therefore not further described. Thus, rotational movement of the outside handle 10 may retract the latch bolt from an extended status to a retracted status for unlocking, which is conventional and therefor not further described. A coil spring 32 is mounted to the first end of the spindle 30, which will be described later.

An outside retractor 36 includes a rectangular hole 361 through which the spindle 30 is extended. The outside retractor 36 further includes two arcuate slots 362 that allow the outside retractor 36 to be engaged with the second end of the outside spindle 20. The outside retractor 36 further includes two lugs 363 formed on a periphery thereof A torsion spring 35 is provided on an end of the outside spindle 30 and includes two ends respectively attached to the lugs 363 for returning the outside spindle 20 and the outside handle 10. A C-clip 37 is mounted in the annular groove 21 of the outside spindle 20 to retain the outside retractor 36 in position.

Figure 3:
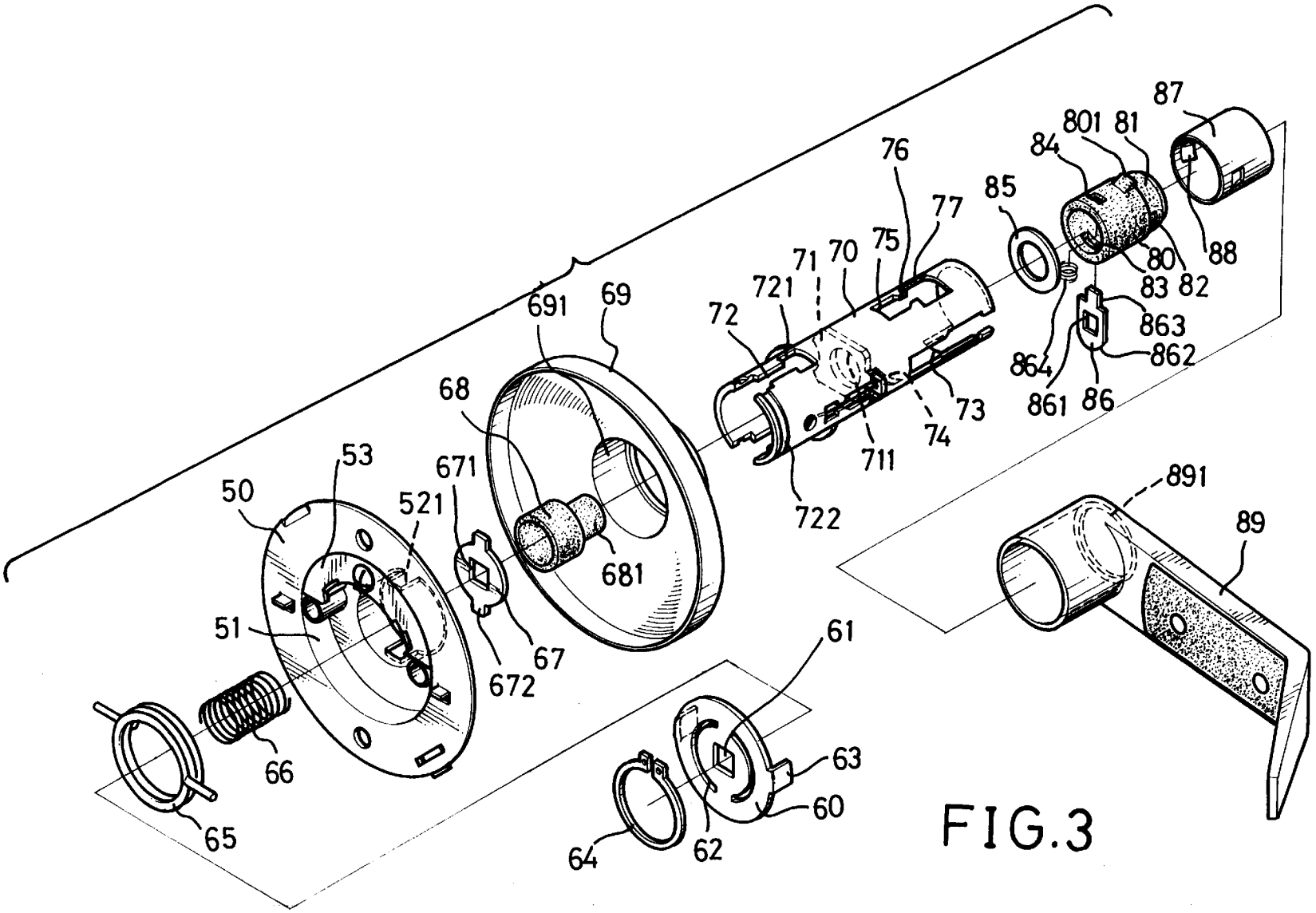
FIG. 3 is an exploded perspective view of an inside handle assembly of the tubular lock in accordance with the present invention.

Referring to FIGS. 3 and 9, the inside handle assembly 2 includes an inside handle 89 (e.g., a lever handle) with a through hole 891 defined therein, an inside spindle 70 having a first end received in the through hole 891 and securely engaged with the inside handle 89 to rotate therewith, and a push button assembly mounted in the through hole 891 of the inside handle 89. The push button assembly includes an inner sleeve 80 slidably received in the inside spindle 70 and a push button 87 having a first end securely engaged with the inner sleeve 80 to move therewith. In this embodiment, the push button 87 includes a number of protrusions 88 formed in an inner periphery thereof for securely engaging with a corresponding number of slots 82 defined in a first end 81 of the inner sleeve 80. As shown in FIG. 9, the push button 87 has a second end that is normally extended beyond the inside handle 89 for manual pushing, which will be described later. The inner sleeve 80 further includes a wedge 801 formed on an outer periphery thereof. Further, the inner sleeve 80 includes a relatively shorter slot 84 and a relatively longer slot 83 defined in a second end thereof The relatively shorter slot 84 is aligned with a portion of the relatively larger slot 83.

A catch 86 is received in the second end of the inner sleeve 80 and slidable along a direction transverse to a longitudinal direction of the through hole 891. As shown in FIG. 3, the catch 86 includes a first end 863 with a spring 864 mounted therearound and a second end 862 and a rectangular hole 861 defined therein.

Figure 4:
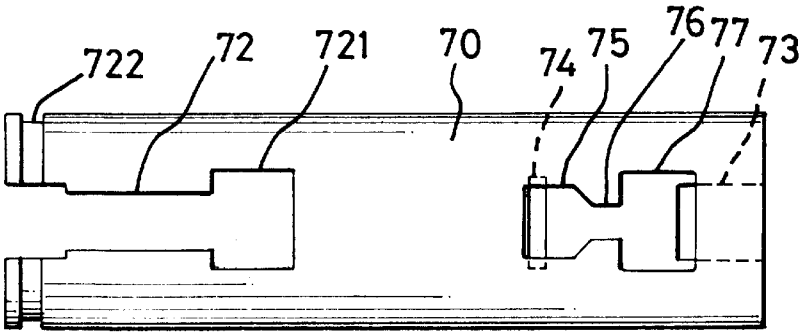
FIG. 4 is a top view of an inside spindle of the tubular lock in accordance with the present invention.

Still referring to FIG. 3, the second end of the inside spindle 70 has an annular groove 722 defined in an outer periphery thereof The second end of the inside spindle 70 further includes aligned longitudinal cutouts 72 defined in the periphery thereof, each cutout 72 having an enlarged end section 721 distal to the second end of the inside handle 70. An inner keeper 71 is securely mounted in the inside spindle 70 and includes a hole 711. Referring to FIGS. 3 and 4, the inside spindle 70 further includes a longitudinal slit 73 and a cutout (see 74, 75, 76) defined in a second end thereof The cutout is opposite to the longitudinal slit 73 and includes a first section 75, a second section 77, and a neck 76 between the first section 75 and the second section 77.

Figure 5:
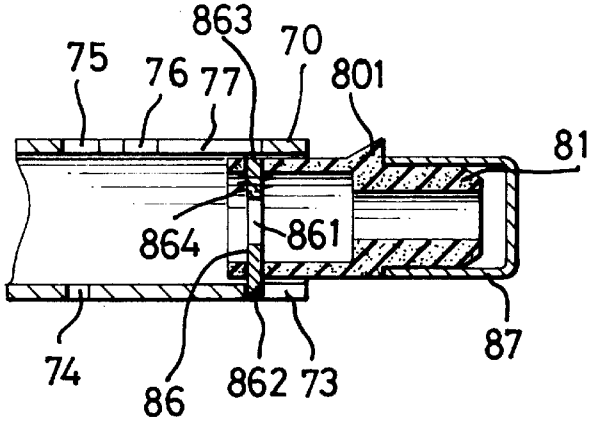
FIGS. 5 to 7 are partial sectional views illustrating assembly of a push button means and the inside spindle of the inside handle assembly.
Figure 7:
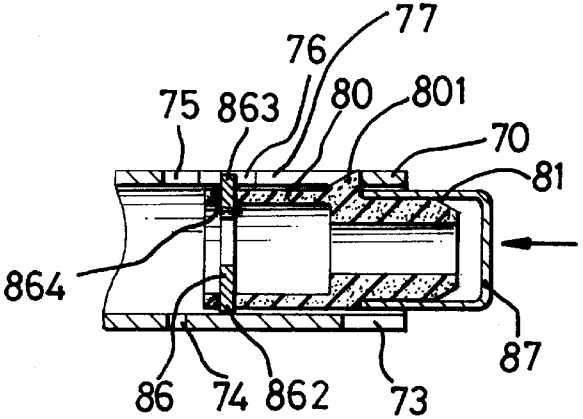
Figure 6:
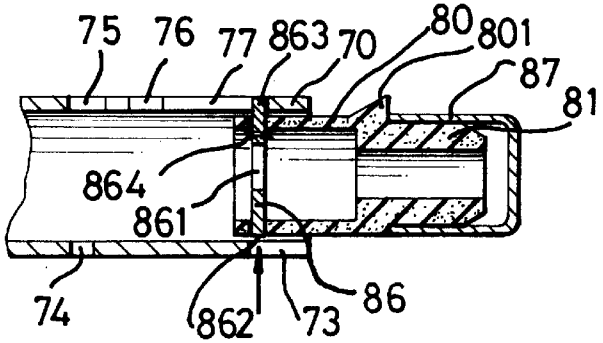

FIGS. 5 to 7 illustrate assembly of the push button assembly to the inside spindle 70. First, the second end of the inner sleeve 80 is partially inserted into the first end of the inside spindle 70. The catch 86 is inserted into the inner sleeve 80 via the slit 73 of the inside spindle 70 and the relatively longer slot 83 of the inner sleeve 80, as shown in FIG. 5. Then, the catch 86 is pushed upwardly (see the arrow in FIG. 6) until the first end 863 is extended out from the relatively shorter slot 84 and into the second section 77 of the cutout of the inside spindle 70, while the second end 862 of the catch 86 is entered into the inside spindle 70 via the slit 73. The push button 87 is then pushed inwardly (see the arrow in FIG. 7) until the second end 862 of the catch 86 leaves the slit 73, and the first end 863 of the catch 86 enters the first section 75 of the cutout in the inside spindle 70. The second end 862 of the catch 86 is biased by the spring 864 toward the inner periphery of the inside spindle 70. As shown in FIGS. 6 and 7, the wedge 801 on the inner sleeve 80 is easily moved into the second section 77 of the cutout in the inside spindle 70 due to provision of the inclined surface (not labeled) thereof, and displacement of the push button assembly from the spindle 77 is prevented due to provision of a steep wall (not labeled) thereof. A further inward movement of the push button assembly may cause the second end 862 of the catch 86 to be extended into a retaining slot 74 defined in the inside spindle 70, which will be described later.

Still referring to FIGS. 3 and 9, a connecting sleeve 68 is mounted in the inside spindle 70 and includes a reduced section 681 slidably received in the hole 711 of the inner keeper 71. As shown in FIG. 9, the second end of the spindle 30 is securely received in the connecting sleeve 68 to rotate therewith, and the second end of the locking bar 34 is extended through the reduced section 681 of the connecting sleeve 68 and engaged with the rectangular hole 861 of the catch 86 to rotate therewith. A washer 85 may be provided between the inner sleeve 80 and the shoulder 681 of the connecting sleeve 68.

The inside handle assembly 2 further includes an inside rose liner 50 mounted to the door panel 3 (FIG. 9) and through which the spindle 30 is extended. The inside handle assembly 2 further includes an inside rose 69 (with a through hole 691) for housing the inside rose liner 50. The inside rose liner 50 includes a compartment 51 defined therein, and a pair of stops 53 are provided on an inner periphery that defines the compartment 51. The inside rose liner 50 further includes a shoulder 52 that includes aligned upper and lower locking grooves 521 defined therein.

The inside handle assembly 2 further includes a locking piece 67 that is mounted in the inside spindle 70 and has two diametrically, outwardly extending lugs 672 that are extended into the enlarged sections 721 of the first end of the inside spindle 70. The locking piece 67 further includes a rectangular hole 671 through which the spindle 30 is extended. As shown in FIG. 9, the locking piece 67 is mounted next to the connecting sleeve 68 and rotatable together with the spindle 30. In addition, an inside retractor 60 includes a rectangular hole 61 through which the spindle 30 is extended, two arcuate slots 62 which allows the inside retractor 60 to be mounted to the first end of the inside spindle 70, and two diametrically disposed lugs 63. A C-clip 64 is mounted in the annular groove 722 of the inside spindle 70 to retain the inside retractor 60 in position. Further, a coil spring 66 is mounted between the inside retractor 60 and the locking piece 67. A torsion spring 65 is mounted around the inside spindle 70 with two ends thereof respectively attached to the two lugs 63 of the inside retractor 60 for returning the inside spindle 70 and the inside handle 89.

Figure 8:
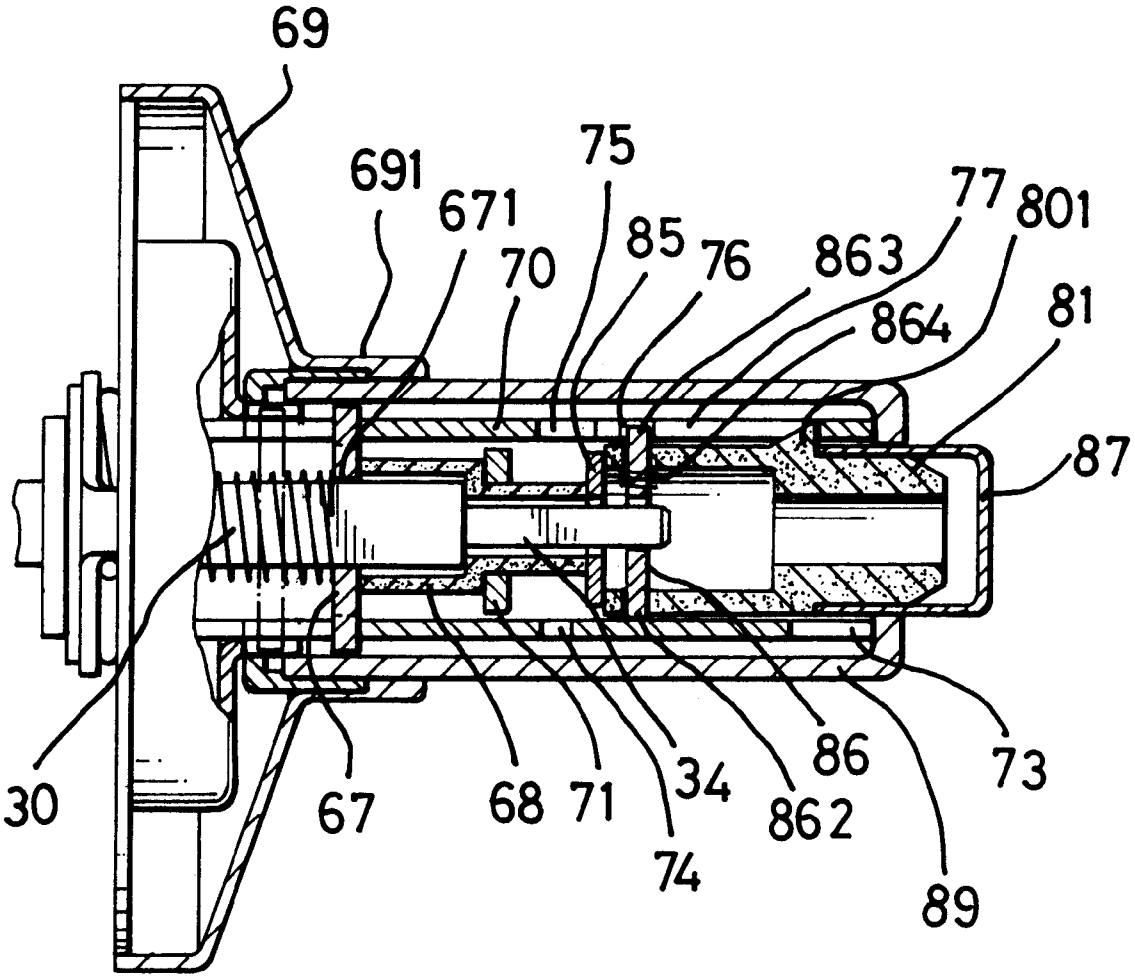
FIG. 8 is a partial longitudinal, vertical sectional view of the inside handle assembly.

FIG. 8 illustrates a partial sectional view of the assembled inside handle assembly. The tubular lock in FIG. 9 is in an unlocked status. In other words, the door can be opened by directly rotating either handle 10 or 89.

Figure 10:
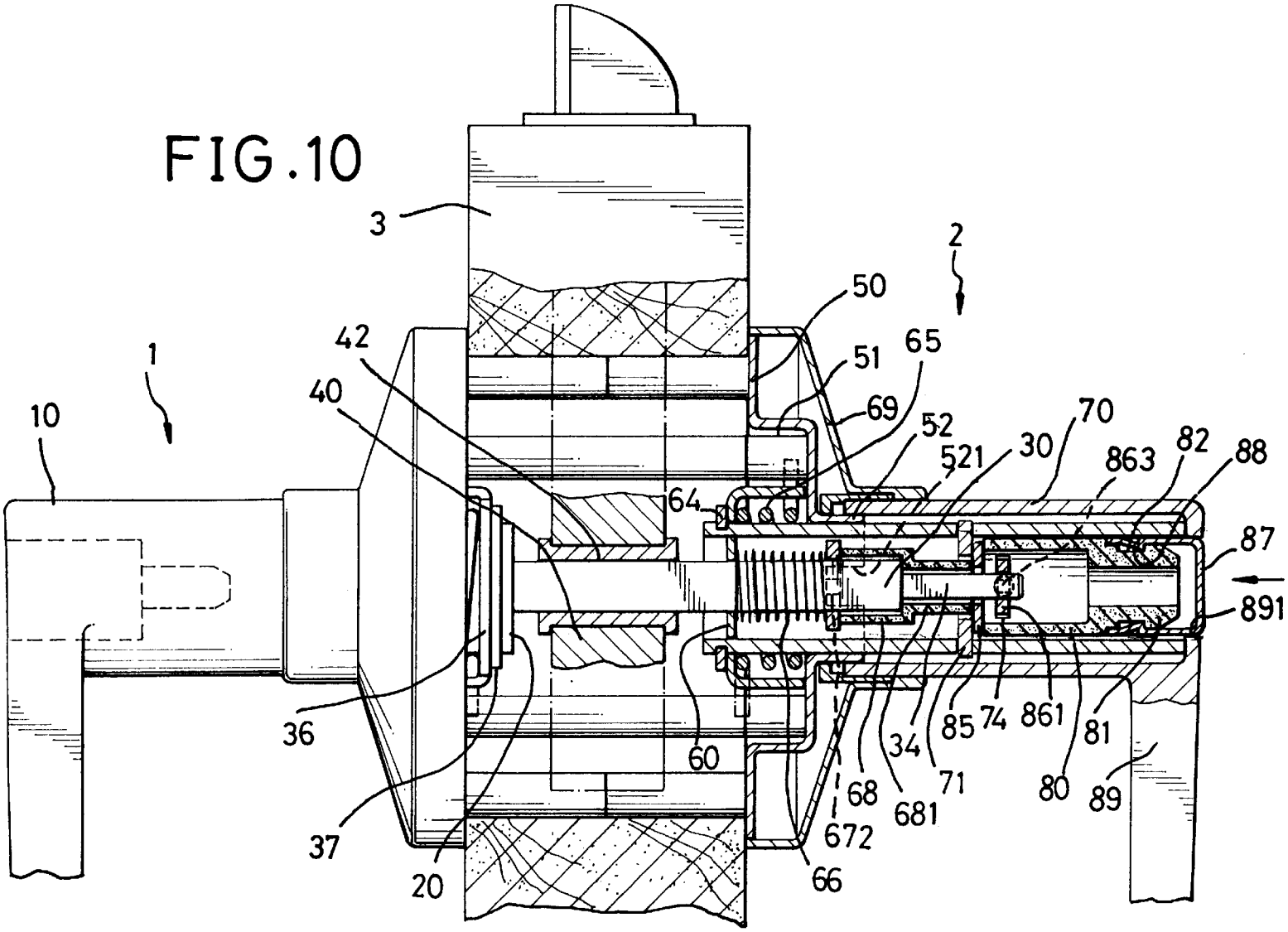
FIG. 10 is a view similar to FIG. 9, illustrating operation of the push button means.
Figure 11:
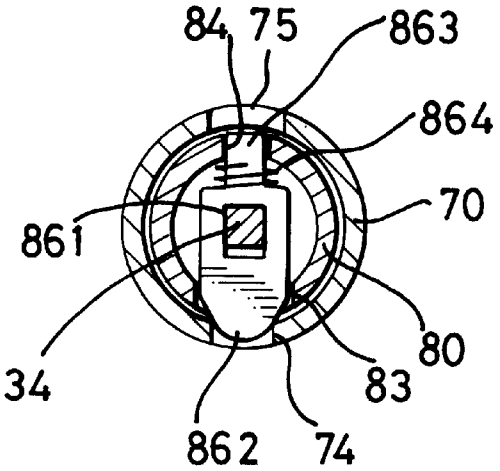
FIG. 11 is a sectional view illustrating engagement relationship between a catch and the inside spindle.

When the push button 87 is pushed into the inside handle 89, as shown in FIG. 10, the catch 86 is moved inwardly and reaches the retaining slot 74 of the inside spindle 70 such that the second end 862 of the catch 86 is extended and thus retained in the retaining slot 74 under the action of the spring 864 (FIG. 11), as mentioned above. The lugs 672 of the locking piece 67 are moved into the associated locking grooves 521 of the inside rose liner 50 and thus retained in position. In this case, the door cannot be opened by means of manually rotating the outside handle 10.

Figure 13:
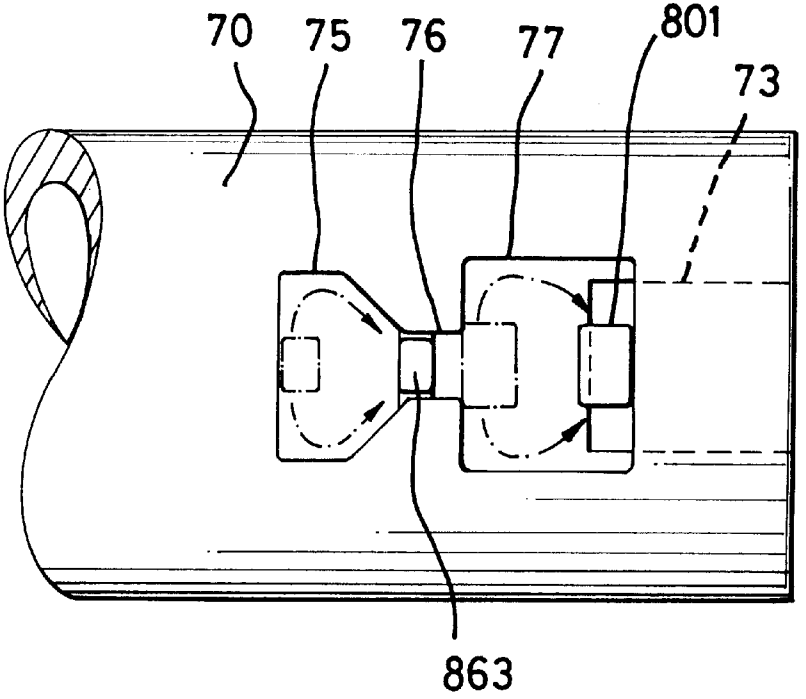
FIG. 13 is a top view illustrating movement of the push button means during unlocking.
Figure 12:
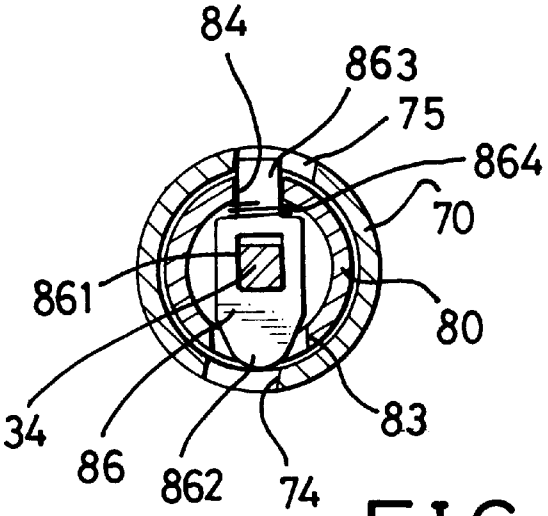
FIG. 12 is a view similar to FIG. 11, illustrating unlocking of the catch.

Referring to FIGS. 10, 12, and 13, when a key is inserted into a key hole (not shown) in the outside handle 10 and rotated, the locking bar 34 as well as the catch 86 are rotated (FIG. 10). Thus, the second end 862 of the catch 86 is disengaged from the retaining slot 74. The spring 66 that is compressed during inward movement of the push button 87 returns the push button 87 and the inner sleeve 80 to their initial positions, as shown in FIG. 13. The lugs of the locking piece 67 are thus disengaged from the locking grooves 521 and thus allow opening of the door. Alternatively, the inside handle 89 can be rotated to urge the inside spindle 70 to rotate. The second end 862 of the catch 86 is moved upwardly by a periphery defining the retaining slot 74 and thus disengaged from the retaining slot 74. The spring 66 that is compressed during inward movement of the push button 87 returns the push button 87 and the inner sleeve 80 to their initial positions, as shown in FIG. 13. Again, the lugs of the locking piece 67 are thus disengaged from the locking grooves 521 and thus allow opening of the door.

It is appreciated that the push button 87 of the tubular lock of the present invention cannot be rotated as the catch 86 is either restrained in the cutout (the first section 75) of the inside spindle 70 by its first end 863 or in the retaining slot 74 by its second end 862.

Accordingly, the tubular lock of the present invention provides an improved function in the prevention of being inadvertently locked outside by provision of the push button means.

Although the invention has been explained in relation to its preferred embodiment, it is to be understood that many other possible modifications and variations can be made without departing from the spirit and scope of the invention as hereinafter claimed.

What is claimed is:

1. A tubular lock, comprising:

an outside handle assembly (1) including an outside handle (10), an outside spindle (20) having a first end securely attached to the outside handle (10) to rotate therewith and a second end, a cam (22) mounted in the second end of the outside spindle (20) and secured to the outside handle (10) to rotate therewith, an outside rose liner (24) adapted to be mounted to a door panel (3), an outside rose (23) securely mounted around the outside rose liner (24), and an outside retractor (36) mounted to the second end of the outside spindle (20), an inside handle assembly (2) including an inside handle (89), an inside spindle (70) having a first end securely attached to the inside handle (89) to rotate therewith, a second end, and a retaining slot (74) defined in an outer periphery thereof, an inside rose liner (50) adapted to be mounted to the door panel (3) and including two locking grooves (521) defined therein, an inside rose (69) securely mounted around the inside rose liner (50), an inside retractor (60) mounted to the second end of the inside spindle (70), a locking piece (67) mounted around a lock spindle (30) to rotate therewith and having two diametrically disposed lugs (672) releasably engaged with the locking groove (521) of the inside rose liner (50), and a first spring (66) mounted between the locking piece (67) and the inside retractor (60), the second end of the inside spindle (70) further including a cutout defined in a periphery thereof, a push button assembly (87, 80) including:

an inner sleeve (80) slidably and irrotatably mounted in the inside handle and including a first end (81), a wedge (801) formed on an outer periphery thereof and retained in the cutout of the inside spindle, and a second end having a relatively shorter slot (84) and a relatively longer slot (83) defined therein, the relatively shorter slot (84) being aligned with a portion of the relatively longer slot (83), a push button (87) having a first end that is normally extended beyond the inside handle (89) when the tubular lock is in an unlocked status and a second end securely engaged with the first end (81) of the inner sleeve (80), and a catch (86) having a first end (863) with a second spring (864) mounted therearound, a second end (862), and a rectangular hole (861), the first end (863) being slidably received in the relatively shorter slot (84), and the second end (862) of the catch (86) being slidably received in the relatively longer slot (83), the lock spindle (30) extending between the outside handle assembly (1) and the inside handle assembly (2) and having a first end attached to the cam (22) to rotate therewith and a second end, a first torsion spring (35) being mounted around the first end of the spindle (30) and having two ends attached to the outside retractor (36) for returning the outside spindle (20) and the outside handle (10), and a second torsion spring (65) being mounted around the second end of the spindle (30) and having two ends attached to the inside retractor (60) for returning the inside spindle (70) and the inside handle (89), a locking bar (34) rotatably mounted in the spindle (30) and having a first end adapted to be actuated by a key and a second end extended beyond the spindle (30) in the inside spindle (70) and engaged with the rectangular hole (861) of the catch (86) to move therewith, and a latch bolt driving member (40) having a rectangular hole (42) through which the spindle (30) is extended to move therewith, the latch bolt driving member having an end adapted to be connected to a latch bolt to move therewith, whereby when the first end of the push button assembly (87, 80) is pressed into the inside handle (89), the locking piece (67) is moved to engaged with and thus retained in the locking grooves (521) of the inside rose liner (50) while the catch (86) is moved to a position in which the second end (862) of the catch (86) is moved into and thus retained in the retaining slot (74) of the inside spindle (70) under the action of the second spring (864), such that the tubular lock cannot be unlocked by rotation of the outside handle, yet rotation of the inside handle (89) causes the second end (862) of the catch (86) to be disengaged from the retaining slot (74) to unlock the tubular lock.

2. The tubular lock according to claim 1, wherein the inside spindle (70) further includes an inner keeper (71) mounted therein, the inner keeper (71) including a hole (711), and further includes a connecting sleeve (68) mounted to the second end of the spindle (30), the connecting sleeve (68) includes a reduced section (681) which extends through the hole (711) of the inner keeper (71) and through which the locking bar (34) is extended.

3. The tubular lock according to claim 1, wherein the cutout in the second end of the inside spindle (70) includes a first section (75), a second section (77), and a neck section (76) between the first section (75) and the second section (77).

4. The tubular lock according to claim 3, wherein the second end of the inside spindle (70) further includes a slit (73) aligned with the cutout of the inside spindle to allow insertion of the catch (86) into the inner sleeve (80) via the slit (73) and the relatively longer slot (83).

5. The tubular lock according to claim 1, wherein the first end (81) of the inner sleeve (80) includes a plurality of slots (82) defined in an outer periphery thereof, and the second end of the push button (87) includes a corresponding number of protrusions (88) formed on an inner periphery thereof so as to be securely received in the slots (82).

* * * * *